US005567503A

United States Patent [19]

Sexton et al.

[11] Patent Number: 5,567,503

[45] Date of Patent: Oct. 22, 1996

[54] POLISHING PAD WITH ABRASIVE PARTICLES IN A NON-POROUS BINDER

[76] Inventors: John S. Sexton, Bobcat, West Street, Odiham; Derek N. Wright, No. 5 Eagle Close, Heathlake, Crowthorne, Berkshire, both of England

[21] Appl. No.: 308,399

[22] Filed: Sep. 19, 1994

Related U.S. Application Data

[63] Continuation of Ser. No. 33,561, Mar. 16, 1993, abandoned.

[30] Foreign Application Priority Data

Mar. 16, 1992 [GB] United Kingdom ..... 9205664
Oct. 12, 1992 [GB] United Kingdom ..... 9221397

[51] Int. Cl.[6] ..... B24D 7/00

[52] U.S. Cl. ..... 428/143; 428/141; 428/137; 428/323; 428/332; 428/338; 428/325; 428/157; 428/167; 428/172; 428/169; 428/195; 428/206; 428/208; 428/210; 428/408; 428/908.8; 51/298; 51/293; 51/307; 51/309; 451/527; 451/529; 451/530; 451/540; 451/543; 451/548; 451/353; 451/359

[58] Field of Search ..... 428/141, 137, 428/143, 323, 332, 338, 325, 157, 167, 172, 169, 195, 206, 208, 210, 408, 908.8; 51/298, 293, 307, 309; 451/527, 529, 530, 540, 543, 548, 353, 359

[56] References Cited

U.S. PATENT DOCUMENTS

| | | | |
|---|---|---|---|
| 1,988,065 | 1/1935 | Wooddell | 451/529 |
| 2,059,583 | 11/1936 | Jackson et al. | 451/529 |
| 2,115,904 | 5/1938 | Bryant | 451/527 |
| 2,806,772 | 9/1957 | Robie | 51/296 |
| 3,353,308 | 11/1967 | Zane | 451/529 |
| 3,383,191 | 5/1968 | Thomas | 51/298 |
| 3,594,963 | 7/1971 | Beasley | 51/293 |
| 3,795,078 | 3/1974 | Coes, Jr. | 51/206.5 |
| 3,928,949 | 12/1975 | Wagner | 51/296 |
| 3,960,518 | 6/1976 | Hall | 51/293 |
| 4,369,046 | 1/1983 | Bruschek et al. | 51/298 |
| 4,549,372 | 10/1985 | Sexton et al. | 51/168 |
| 4,787,362 | 11/1988 | Boucher et al. | 125/15 |
| 4,927,432 | 5/1990 | Budinger et al. | 51/298 |
| 5,049,165 | 9/1991 | Tselesin | 51/295 |
| 5,197,249 | 3/1993 | Wiand | 451/529 |
| 5,243,790 | 9/1993 | Gagne | 451/529 |

FOREIGN PATENT DOCUMENTS

| | | |
|---|---|---|
| 0395162 | 10/1990 | European Pat. Off. . |
| 2532875 | 3/1984 | France . |
| 59-93264 | 5/1984 | Japan . |
| 60-167770 | 8/1985 | Japan . |

*Primary Examiner*—William Watkins
*Attorney, Agent, or Firm*—Scully, Scott, Murphy & Presser

[57] ABSTRACT

A polishing pad comprises a carrier and layer of a non-porous thermoplastic polymer secured to a surface thereof and containing a mass of discrete abrasive particles, comprising diamond or cubic boron nitride, uniformly dispersed therein. The abrasive particles have a particle size of up to 500 microns and are present in the layer in a concentration of up to 30 volume percent. The layer presents an abrasive polishing surface. The abrasive layer may also comprise a plurality of spaced strips secured to a surface of the carrier and each strip presents an abrasive polishing surface.

10 Claims, 3 Drawing Sheets

POLISHING PAD WITH ABRASIVE PARTICLES IN A NON-POROUS BINDER

This is a continuation of application Ser. No. 08/033,561, filed on Mar. 16, 1993, abandoned.

BACKGROUND OF THE INVENTION

This invention relates to a polishing pad.

Polishing pads are used extensively in industry for fine finishing or polishing various workpieces, which are typically stone or ceramic in nature. Such polishing pads consist of a carrier having a layer of abrasive particles suitably secured to a surface thereof. The abrasive particles may be secured to the surface of the carrier by means of metal or resin binders. One such polishing pad is described in U.S. Pat. No. 4,927,432. This polishing pad comprises a porous thermoplastic resin matrix reinforced with a fibrous network and optionally containing abrasive particles such as silicon carbide, cerium oxide, titanium oxide or diamond. The pad is used for polishing silicon wafers by chemical attack, the pores being necessary to accommodate liquid chemical reagent.

SUMMARY OF THE INVENTION

According to the present invention, a polishing pad comprises a carrier and a layer of a non-porous thermoplastic resin secured to a surface thereof, and containing a mass of discrete abrasive particles uniformly dispersed therein, the abrasive particles having a particle size of up to 500 microns, typically 2 to 300 microns, and being present in the layer in a concentration of up to 30 volume percent, and the layer presenting an abrasive polishing surface.

DESCRIPTION OF EMBODIMENTS

Figure 1:
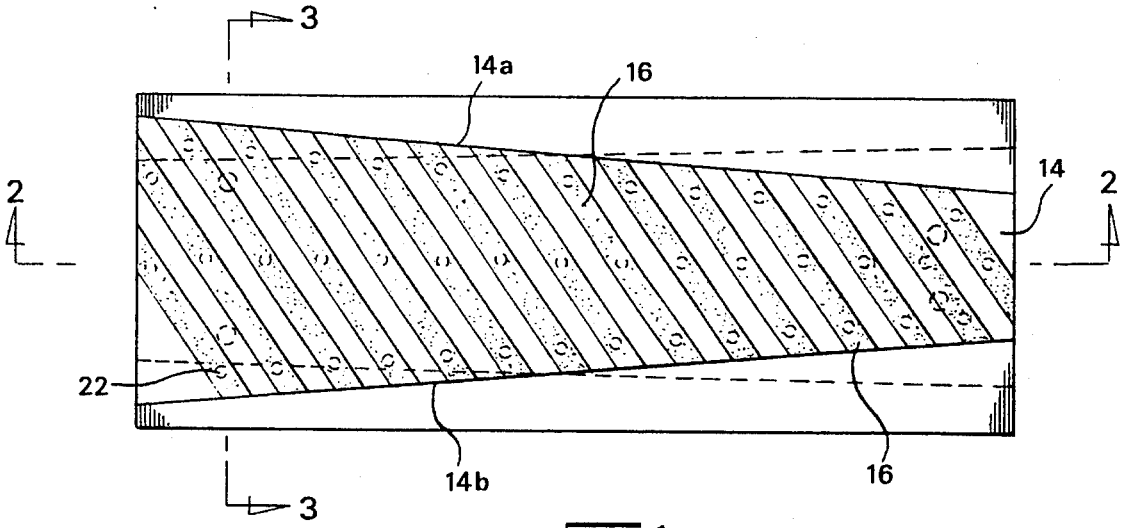
FIG. 1 illustrates a plan view of a first embodiment of the invention.
Figure 2:
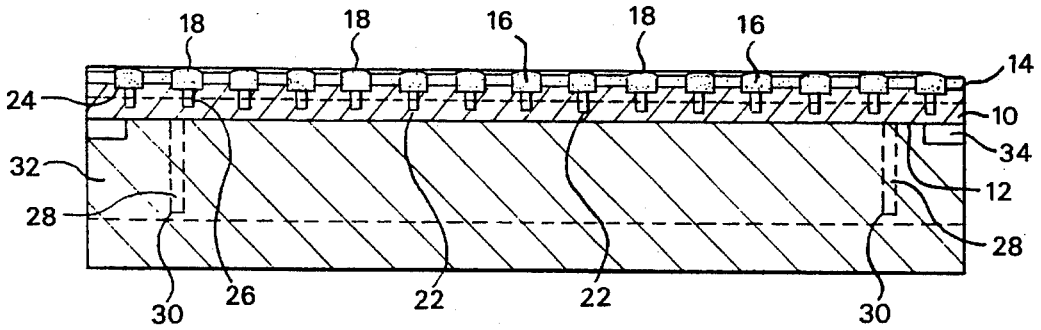
FIG. 2 is a section along the line 2—2 of FIG. 1.
Figure 3:
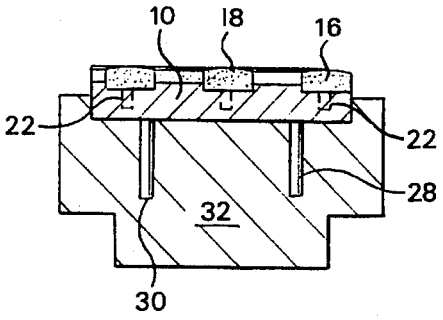
FIG. 3 is a section along the line 3—of FIG. 1.

The carrier for the polishing pad may be rigid or flexible. It may be may be made of a metal such as steel, or a polymer which may be thermosetting or thermoplastic. Examples of suitable thermosetting polymers are phenolic and polyurethane. Examples of suitable thermoplastic polymers are acrylonitrile butadiene styrene and polypropylene.

The carrier will typically have major surfaces on opposite sides thereof, and the abrasive layer will be secured to one of these surfaces. The abrasive layer will generally cover up to 70 percent of the surface to which it is secured.

In one form of the invention, the abrasive layer presents a continuous polishing surface and is secured to one of the major carrier surfaces. Typically, the thickness of such a layer will be in the range 0.1 mm to 2 mm. such a layer may be applied to the surface by multiple spraying, for example multiple electrospraying. In such a method, the polymer mixed with the abrasive particles will be sprayed directly on to the surface of the carrier. The surface will typically be heated to 400° C. to 500° C. Using such a method will result in the abrasive layer being bonded directly to the carrier surface. Alternatively, the abrasive layer may be produced by injection moulding and thereafter secured, for example, by bonding, to the carrier surface.

In another form of the invention, the abrasive layer comprises a plurality of spaced strips secured to a surface of the carrier and each strip presents an abrasive polishing surface. Thus, in this form of the invention, the abrasive polishing surface for the pad will be a discontinuous surface. Generally, the carrier will have major surfaces on opposite sides thereof and each major surface will have opposed longitudinal edges. The spaced strips may be secured to one of the major surfaces such that they lie transverse to the longitudinal edges of that surface. The strips may be secured by bonding them, for example, using an adhesive, to the carrier surface. Preferably, the strips are secured to the carrier surface by engaging complemental formations on or in the strip and carrier surface. These complemental formations may, for example, be complemental pins and holes. In this form of the invention, it is preferred that the strips are produced by injection moulding.

When the polishing surface is a continuous polishing surface, it is preferably convex in shape. When the polishing surface is discontinuous and provided by a plurality of spaced strips, the polishing surface of each strip may be flat or convex in shape.

The abrasive particles will typically be ultra-hard abrasive particles such as diamond or cubic boron nitride.

The abrasive layer may include fillers which may be in the form of fibres or particles. For example, the filler may be bronze powder to improve thermal conductivity, silica powder for abrasion resistance, alumina for wear resistance, or PTFE, silicon or graphite for improved lubricity.

The thermoplastic polymer for the abrasive layer is preferably selected from one or more of the following polymers:

Polyetheretherketone (PEEK) and polyetherketone (PEK) such as that marketed by ICI under the trade name VICTREX®. Polyaryletherketone such as that marketed by BASF under the trade name ULTRAPEK®. Poly (amide-imide) such as that marketed by Amoco under the trade name TORLON®. Polyphenylene sulphide (PPS) such as that marketed by Phillips under the trade name RYTON®. Liquid Crystal Polymer (LCP) such as that marketed by Hoechst under the trade name VECTRA®.

A first embodiment of the invention will now be described with reference to FIGS. 1 to 4 of the accompanying drawings. Referring to these Figures, a polishing pad comprises a carrier 10 having major flat surfaces 12, 14 on opposite sides thereof. The one major surface 14 has a plurality of spaced abrasive strips 16 secured to it.

Figure 4:
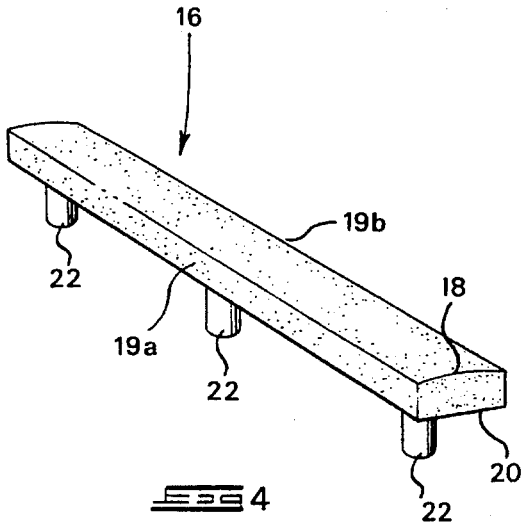
FIG. 4 illustrates a perspective view of an abrasive strip for use in the first embodiment of the invention.

FIG. 4 illustrates one such strip. The strip is elongate in shape having a convex upper surface 18 and a flat lower surface 20. Integrally formed with the lower surface 20 are three spaced pins 22. The polymer of the strip 16 will preferably be a thermoplastic polymer and the strip made by injection moulding. Any one of the thermoplastic polymers described above may be used. The abrasive particles will preferably be diamond.

The strips 16 are secured to the surface 14 by locating each strip in a recess 24 and the pins in complemental holes 26 formed in the carrier 10. Each strip presents an upper convex polishing surface 18. The polishing surface 18 may also be flat. Further one of the side surfaces 19*a* and 19*b* may be convex and the other concave, rather than flat, as illustrated.

For ease of manufacture in injection moulding the strips 16 may have a plurality of fine holes extending from surface 18 to surface 20 or a number of cut-outs formed in the surface 18.

The strips 16 are arranged across the surface 14 such that they extend across the whole of this surface and are transverse and diagonal to the longitudinal edges 14*a* and 14*b* of that surface 14. This arrangement is a preferred arrangement because the polishing pad, in use, will be mounted on a polishing head for rotation about an axis transverse to the longitudinal edges 14*a* and 14*b*.

The carrier 10 has spaced pins 28 integrally formed with the lower surface 12. These pins 28 are received by complemental holes 30 in a base 32, the base 32 being adapted to be mounted on a polishing head. The location of the pins 28 in the holes 30 detachably secures the carrier 10 to the base 32. The engagement of the pins 28 in the holes 30 is such that the carrier 10 will be firmly secured to the base 32 to enable polishing to take place. However, when the abrasive strips 16 have worn to a point where effective polishing is no longer possible, the carrier may be removed by inserting an instrument such as a screwdriver in recess 34 and prising the carrier off the base. A new carrier with abrasive strips can then be attached to the base 32.

The polishing pad provides effective polishing which, it has been found, can achieve in excess of 1000 square meters of granite polishing for a three millimeter height of abrasive strip. Since both the strips and the carrier can, and preferably are, made by injection moulding, this can be achieved at a relatively low cost. When the pad is consumed, it can be replaced quickly and easily by a new pad.

The base 32 may be made of metal or a polymer such as acetal polymer.

The distance between the polishing surface 18 of each strip and the surface 14 of the carrier will generally be up to 5 mm, and typically 1 to 3 mm.

Figure 5:
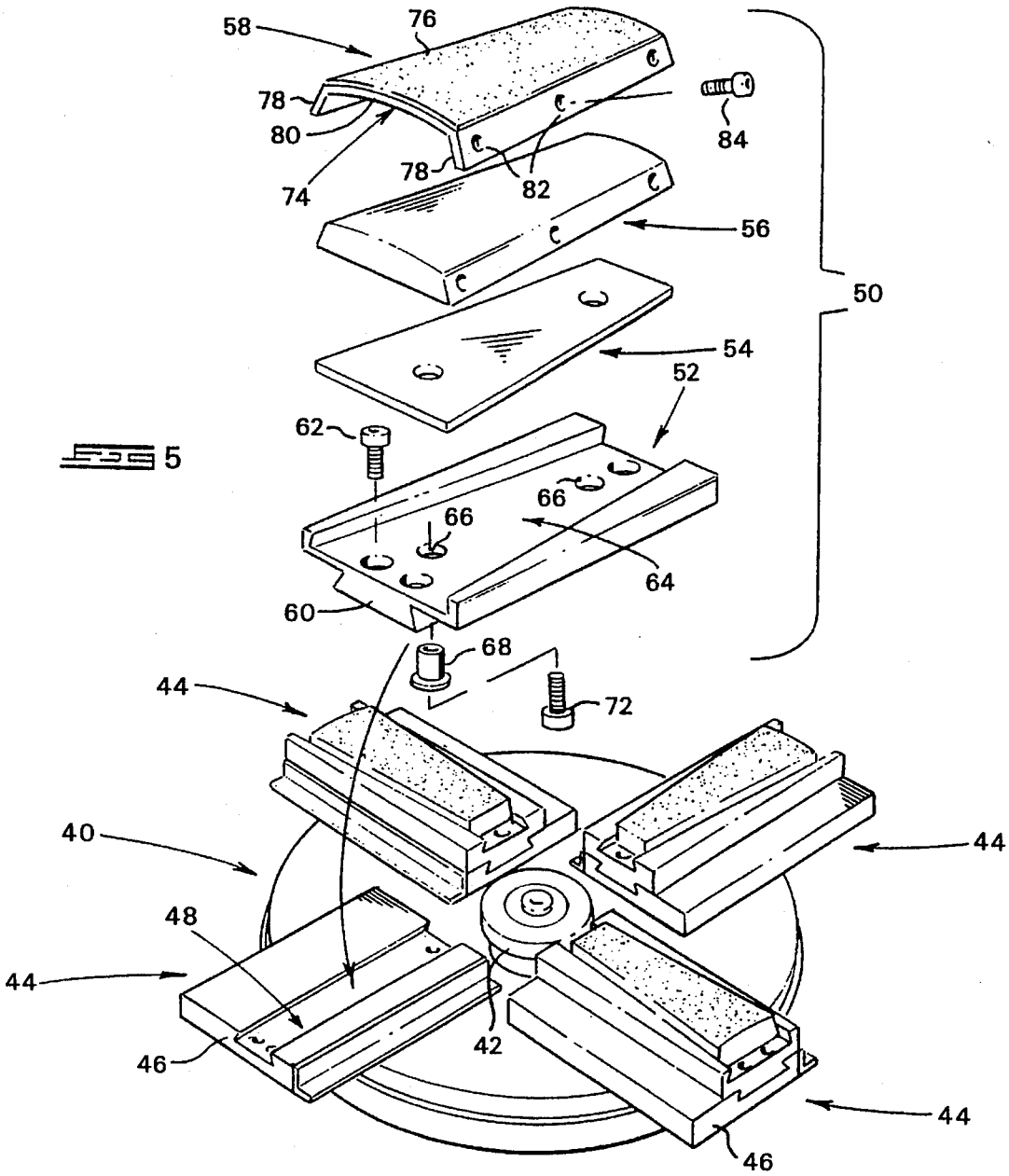
FIG. 5 illustrates a polishing pad assembly utilising a second embodiment of the invention, in partial exploded view.
Figure 6:
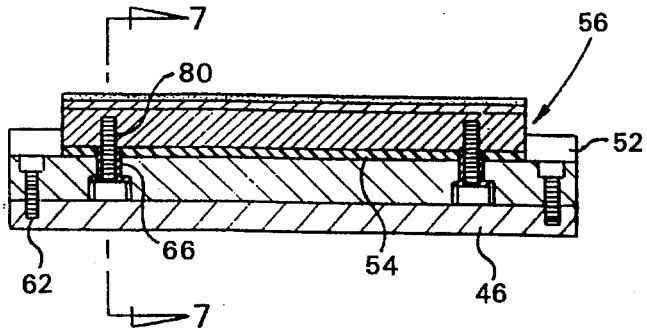
FIG. 6 is a longitudinal cross-section through one of the polishing pad assemblies seen in FIG. 5.

A second embodiment of the invention will now be described with reference to FIGS. 5 to 7. FIG. 5 shows the rotary polishing head 40 of a known polishing apparatus used to polish the surface of a material such as granite or marble. The polishing head 40 has an off-centre hub 42 and four arms 44 radiating from the hub. Each arm 44 includes an elongate support member 46 which is formed with a longitudinal recess 48 of dovetail section.

FIG. 5 also shows four polishing pad assemblies 50, one for each arm 44. Each assembly 50 has four main components, namely a base 52, an intermediate pad 54, an insert 56 and a polishing pad 58.

The base 52 in each case is made of metal or polymer and has a longitudinally extending locating portion 60 which is of dovetail section and which is dimensioned to slide radially into the recess 48 of one of the support members 46. Screws 62 passing downwardly through the base 52 serve to adjust the base in position on the support member 46 such that the abrasive layer 76 is parallel to a surface which is to be polished.

Each base 52 is formed with a longitudinally extending recess 64 which tapers down in width in a radially inward direction. The sides of the recess 64 are slightly undercut. In addition, each base is formed with screw holes 66 countersunk from below as illustrated in FIG. 7.

The intermediate pads 54 are made of a material such as natural or synthetic rubber and are resilient. They have a tapering shape and are located in the recesses 64.

The inserts 56 are made of metal or polymer and each has a slightly tapering shape in cross-section. Each insert is formed with threaded holes 70 which align with the screw holes 66, and with corresponding holes in the pad 54, when the insert is slipped radially to the appropriate position in the relevant recess 64. Cap screws 72 are located in the aligned holes to secure the insert to the base.

Figure 7:
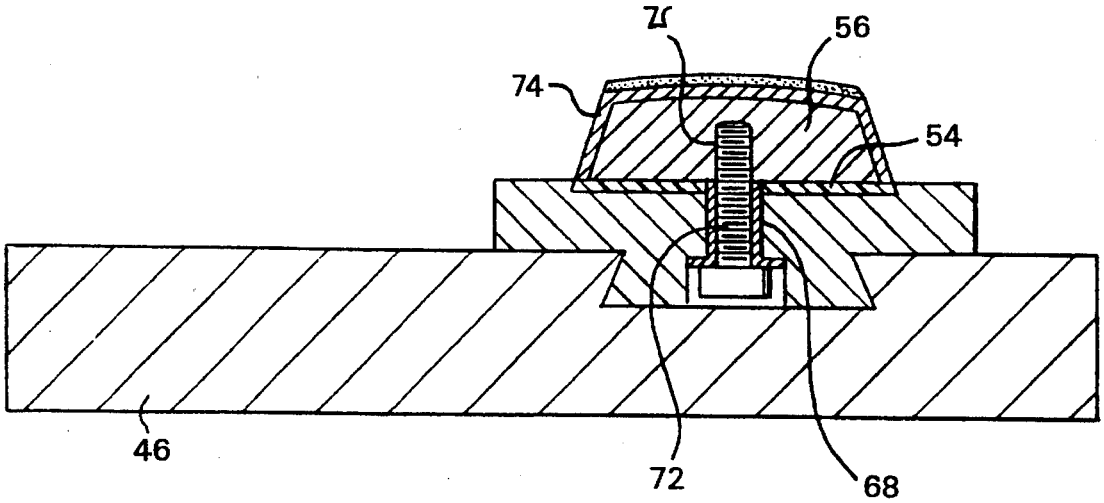
FIG. 7 shows an enlarged section on the line 7—7 in FIG. 6.

Referring to FIG. 7, it will be noted that spacers 68 are provided in each hole 66. The spacers 68 limit the amount by which the insert 56 can be drawn towards the base, and hence the compressive force that is applied to the pad 54 when the screws 72 are fully tightened.

Each polishing pad 58 has a steel carrier 74 and an abrasive layer 76 which extends over the carrier. The abrasive layer 76 is provided by a suitable thermoplastic polymer having a mass of discrete abrasive particles uniformly dispersed therein. The layer 76 may be applied to the carrier by a multiple spraying technique.

The carrier 74 has side flanges 78 and a central section 80 which is slightly arcuate in transverse cross-section. The abrasive layer 76 extends only over the central section 80 and has a continuous convex upper polishing surface. The flanges 78 are formed with longitudinally spaced holes 82.

The abrasive pad 58 is of tapering shape and the side flanges 78 of the carrier are correspondingly convergent in a direction towards the narrower end of the pad.

During assembly, the pads 58 are located over the inserts 56 with the inserts embraced between the flanges 78, and are secured to the inserts by cap screws 84 which pass through the holes 82 and into corresponding, threaded holes formed in the inserts.

In use, the polishing head 40 is rotated and the polishing pad assemblies describe a pendular path. The polishing surfaces presented by the abrasive layers 76 of the polishing pads 58 are applied with appropriate axial pressure to a surface such as a surface of a block of granite. These polishing surfaces apply a polishing action to the relevant surface.

When the abrasive layers 76 of the abrasive pads 58 have worn excessively, it is a simple matter to replace the worn pads with new pads merely by releasing the cap screws 84.

Several different compositions for the abrasive layer, all using diamond as the abrasive, have been tried and found to be successful. Examples of these compositions are:

| Polymer | Diamond Concentration Vol. % | Diamond Size (Microns) |
|---|---|---|
| PEEK | 16 | 53–63 |
| PEEK | 12 | 190 |
| PEEK | 10 | 115 |
| PEEK | 8 | 90 |
| PEEK | 6 | 60 |
| PEEK | 4 | 20 |
| PEEK | 1 | 5 |

We claim:

1. A polishing pad comprising a carrier having major surfaces on opposite sides thereof, said major surfaces having longitudinal edges, and at least one of said major surfaces having an abrasive layer structure secured thereto, said abrasive layer structure comprising a plurality of elongate strips arranged to extend generally transversely to the longitudinal edges of said at least one major surface in spaced relationship to each other so as to form regions of empty interspaces therebetween, depending pin members being formed on a surface of each of said elongate strips facing said at least one major surface and being clampingly engaged in complementary apertures formed in said at least one major surface so as to constitute a unitary structure with said carrier;

a base member of said polishing pad having a surface mounting said unitary structure comprising said abrasive layer structure and said carrier, said carrier having a plurality of elongate pin members extending into complementary holes formed in a surface of said base member facing a surface of said carrier opposite the surface of said carrier mounting said plurality of elongate strips, whereby said unitary structure of said abrasive layer of strips and barrier are conjointly detachable from said base member and replaceable by another said unitary structure.

2. A polishing pad according to claim 1, wherein each said elongate strip comprises a layer of a non-porous thermoplastic polymer containing a mass of discrete abrasive particles uniformly dispersed therein, the abrasive particles having a particle size of up to 500 microns and being present in the layer in a concentration of up to 30 volume percent, and the layer presenting an abrasive polishing surface.

3. A polishing pad according to claim 1, wherein said elongate strips are secured to said one major surface such as to extend diagonally to the longitudinal edges of said surface.

4. A polishing pad according to claim 1, wherein said strips are evenly spaced across the carrier surface to which they are secured.

5. A polishing pad according to claim 2, wherein said strips cover up to 70% of the carrier surface to which they are secured.

6. A polishing pad according to claim 1, wherein each of said strips possesses a convex polishing surface.

7. A polishing pad according to claim 2, wherein the particle size of the abrasive particles is in the range 2 to 300 microns.

8. A polishing pad according to claim 2, wherein the concentration of abrasive particles in the abrasive layer is in the range 1 to 12 volume percent.

9. A polishing pad according to claim 2, wherein the abrasive particles are selected from diamond and cubic boron nitride.

10. A polishing pad according to claim 2, wherein the thermoplastic polymer is selected from the group of materials consisting of polyetheretherketone, polyetherketone, polyaryl ether ketone, poly(amide-imide), polyphenylene sulphide, and liquid crystal polymer.

* * * * *